US005516110A

United States Patent [19]

Yabuki et al.

[11] Patent Number: 5,516,110

[45] Date of Patent: May 14, 1996

[54] TWO PIECE GOLF BALL

[75] Inventors: Yoshikazu Yabuki; Seiichiro Endo, both of Akashi, Japan

[73] Assignee: Sumitomo Rubber Industries, Ltd., Kyogo, Japan

[21] Appl. No.: 119,849

[22] Filed: Sep. 13, 1993

[30] Foreign Application Priority Data

Sep. 21, 1992 [JP] Japan ..... 4-250952

[51] Int. Cl.[6] ..... A63B 37/06; A63B 37/12

[52] U.S. Cl. ..... 473/372; 273/DIG. 22; 473/377

[58] Field of Search ..... 273/218, 230, 273/235 R, 62, 220, DIG. 22

[56] References Cited

U.S. PATENT DOCUMENTS 4,570,937 2/1986 Yamada ..... 273/218

OTHER PUBLICATIONS

Abstract, Section Ch, Week 8526, Derwent Publications Ltd., London, GB; Class A86, AN 85-157367 & JP-A-60 090 575 (Suminoto Rubber Ind) May 21, 1985.

*Primary Examiner*—George J. Marlo
*Attorney, Agent, or Firm*—Birch, Stewart, Kolasch & Birch

[57] ABSTRACT

The objective of the present invention is to bring hit feeling of two-piece balls closer to that of thread-wound golf balls. The two-piece golf ball of the present invention comprises a core formed from a rubber composition comprising a base rubber, a co-crosslinking agent and an organic peroxide, and a cover covering the core, wherein said core has the following hardness distribution when measured by a JIS-C hardness meter;

(1) hardness at a center: 58–73

(2) hardness at 5–10 mm from the center: 68–78

(3) hardness at 15 mm from the center: 76–88

(4) surface hardness: 78–88

(in the hardness distribution, hardness (2) is substantially constant being within the above range, of which tolerance is within ±3 and the other values satisfy the relation of (1)<(2)<(3)≦(4) ), a compression deformation of the core is 2.8–3.5 mm when pressurized by an initial load of 10 kg up to a final load of 130 kg and said cover has a thickness of 1.5–1.9 mm.

5 Claims, 1 Drawing Sheet

TWO PIECE GOLF BALL

FIELD OF THE INVENTION

The present invention relates to a two-piece golf ball, in particular, to a two-piece golf ball with improved hit feeling.

BACKGROUND OF THE INVENTION

Two-piece golf balls are widely used because of its excellent flight performance. However, they have drawbacks, for example, hit feeling is harder than thread-wound golf balls and particularly when a bad shot is made, they give even harder feeling. Therefore the advent of a two-piece golf ball with good hit feeling has been desired.

Various efforts have been made to bring the hit feeling of the two-piece golf ball closer to that of the thread-wound golf ball. For instance, the core of a two piece golf ball is made more flexible to reduce a hardness of the entire ball and thereby improve hit feeling (see Japanese Kokai Publication 63(1988)-220889). However, when a golf ball obtained by this method is hit, it feels rather heavy, although it is more flexible and its hit feeling is not necessarily similar to the hit feeling of the thread-wound golf ball. When viewed from hardness distribution and compression strength, its impact force is large and hit feeling is not good enough.

SUMMARY OF THE INVENTION

The present invention provides a two-piece golf ball having hit feeling closer to that of a thread-wound golf ball, which is obtained by controlling the characteristics of its core and a thickness of its cover.

The present inventors have paid attention to hardness distribution, compression strength of the core and the thickness of the cover and have repeated various researches. As the result, the present inventors discovered that by making the hardness distribution of the core more rigid at the outside and softer at the inside, adjusting the compression strength of the core, reducing the thickness of the cover to 1.5–2.1; mm (which is normally 2.1–2.4 mm) and optimizing these factors, it is possible to obtain a two-piece golf ball having a cover with no hit feeling of hardness and the core with light hit feeling and appropriate flexibility, the ball as a whole being soft and light, having better carry than the conventional balls, without excessively reducing its hardness (expressed by PGA).

The present invention provides a two-piece golf ball comprising a core formed from a rubber composition comprising a base rubber, a co-crosslinking agent and an organic peroxide, and a cover covering the core, wherein said core has the following hardness distribution when measured by a JIS-C hardness meter;

(1) hardness at a center: 58–73

(2) hardness at 5–10 mm from the center: 68–78

(3) hardness at 15 mm from the center: 76–88

(4) surface hardness: 78–88

(in the hardness distribution, hardness (2) is substantially constant being within the above range, of which tolerance is within ±and the other values satisfy the relation of (1)<(2)<(3)≦(4) ), a compression deformation of the core is 2.8–3.5 mm when pressurized by an initial load of 10 kg up to a final load of 130 kg and said cover has a thickness of 1.5–2.1 mm.

DETAILED DESCRIPTION OF THE INVENTION

Figure 1:
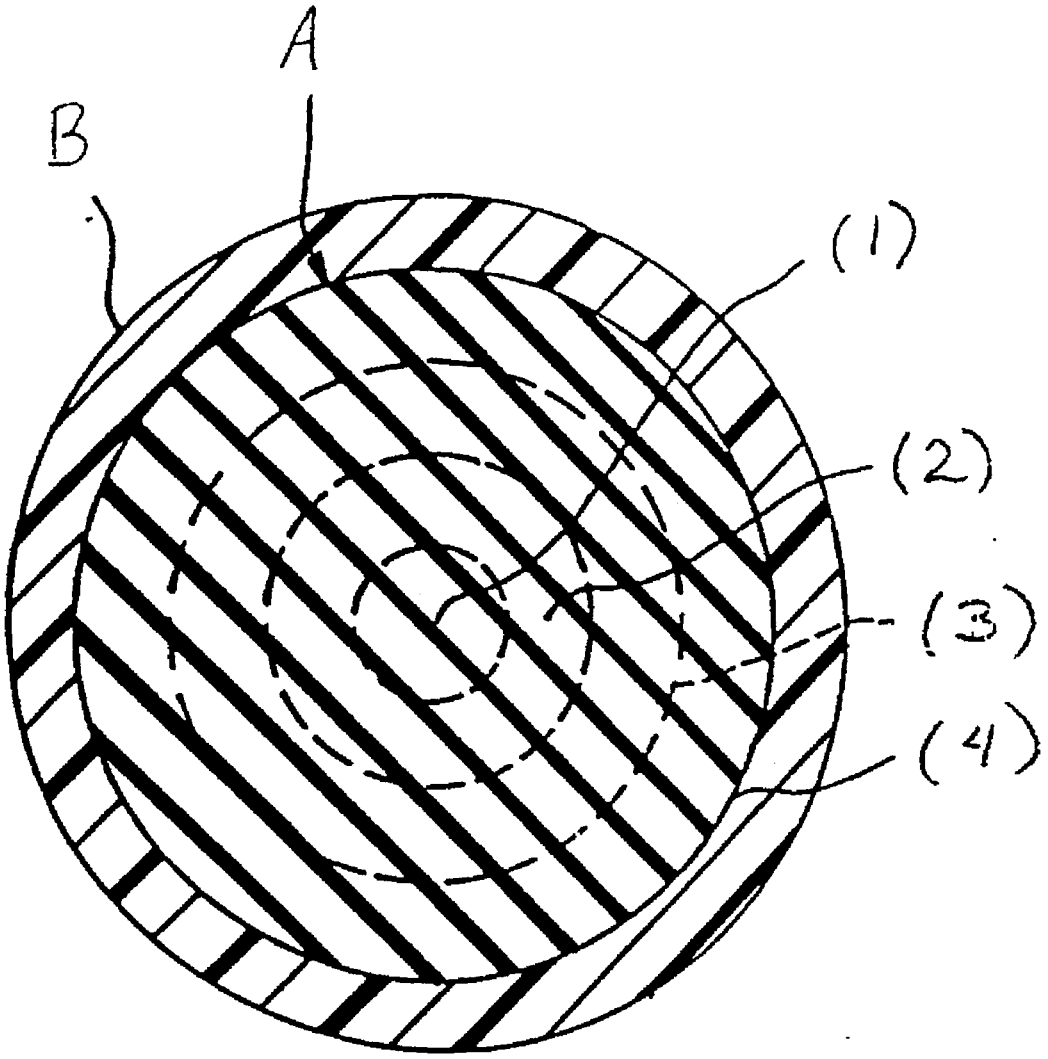
FIG. 1 is a cross-sectional illustration of a golf ball according to the present invention, having a core, A, and a cover, B. Within the core are sections (1) the center; (2) a section 5–10 mm from the center; (3) a section 15 mm from the center; and (4) the surface of the core.

The base rubber used in the present invention may be natural and/or synthetic rubber which has been conventionally used for a two-piece core. In particular, cis-1,4-polybutadiene rubber containing at least 40% of cis structure is preferred. If desired, natural rubber, polyisoprene rubber, styrene rubber, EPDM etc. may be blended into the polybutadiene rubber in appropriate amounts.

The co-crosslining agent is not particularly restricted but, for example, metal salt of unsaturated carboxylic acid, in particular, a monovalent or divalent metal salt of the unsaturated carboxylic acid having 3 to 8 carbon atoms (for example, acrylic acid, methacrylic acid etc.). Zinc diacrylate is particularly preferred. The amount of the co-crosslining agent is 20–35 wt parts, preferably 25–32 wt parts based on 100 wt parts of the base rubber. If the amount is less than 20 wt parts, hardness of the ball is insufficient and the ball has heavy and inferior hit feeling and durability is also inferior. When the amount exceeds 35 wt parts, the ball is too hard and hit feeling is also inferior.

The organic peroxide may be dicumyl peroxide or di-t-butylperoxide, but dicumyl peroxide is particularly preferred. The amount of the organic peroxide is 0.5–5.0 wt parts, preferably 1.0–3.0 wt parts based on 100 wt parts of the base rubber. If it is less than 0.5 wt part, the hardness of the ball is insufficient and hit feeling of the ball is heavy and inferior, while if it exceeds 5.0 wt parts, the ball is too hard and hit feeling is inferior.

The rubber composition used for the golf ball of the present invention may contain such additives as filler, antioxidant, etc., if necessary. The filler generally used may be zinc oxide, barium sulfate etc. and the amount in the composition depends on specific weight, size etc. of the cover and the core and is not particularly restricted, but it is usually 10–40 wt parts based on 100 parts of the base rubber.

The core for the two-piece golf ball is formed by kneading the rubber composition sufficiently and curing in a mold. Kneading conditions and curing conditions are well-known to the industry but, usually curing is conducted at a temperature of 140°–180° C. for 15–55 minutes.

The core of the golf ball of the present invention is preferred to have such hardness distribution when measured by a JIS-C hardness meter that it satisfies the conditions of (1) 58–73 at a center, (2) 68–78 at 5–10 mm from the center, (3) 76–88 at 15 mm from the center and (4) 78–88 at the surface. Particularly, the hardness (2) should be substantially constant of which tolerance is less than ±3. The-hardness values also satisfies the relation of (1) (2)<(3)≦(4). The technology to specifically control the hardness distribution as above is described in Japanese Kokai Publication Sho 60(1985)-90575.

When hardness range is less than the aforesaid range, durability decreases and the ball is exceedingly flexible and gives heavy hit feeling. When hardness is higher than the above range, the impact force at the time of hitting is too large and hit feeling is inferior. When the hardness distribution is such that the hardness is higher as it is closer to the core surface, impact force is larger than those described in the present invention, hit feeling of softness is inferior while in the case of the hardness distribution having flat section as in the present invention, the impact force is small and the ball with soft hit feeling is obtained and durability is also good:

Also it is necessary that the compression deformation of said core is 2.8–3.5 mm when it is loaded with an initial load of 10 kg up to a final load of 130 kg. Such compression deformation may be controlled mainly by the amount the metal salt of the unsaturated carboxylic acid but it may be controlled also by the amounts of other chemicals, curing conditions etc. By whichever method it may be controlled, if the deformation of core exceeds 3.5 mm, rebound coefficient decreases and flight performance is inferior. Basically, the ball is too soft and heavy and its hit feeling is insecure and durability is lower. On the contrary if deformation is less than 2.8 mm, the ball is too hard and hit feeling is inferior.

By covering the core obtained above with a cover having a thickness of 1.5–2.1 mm, a two-piece golf ball is obtained. The cover is generally made from a cover composition which mainly comprises an ionomer resin and, upon necessity, a filler for coloring agent (for example, titanium dioxide barium sulfate, etc.). When the thickness of the cover is less than 1.5 mm, the ball spins easily and the hit feeling is closer to that of a one-piece golf ball. When it is thicker than 2.1 mm, hit feeling is inferior.

In the present invention, it is preferred to adjust a stiffness of the cover within 3,000–4,500 kg/cm$^2$. When it is smaller than 3,000 kg/cm$^2$, the cover is too flexible and the ball spins easily and the hit feeling is soft, heavy and insecure. Whereas if it exceeds 4,500 kg/cm$^2$, it is hard and gains heavy hit feeling.

The method to coat the ionomer resin cover on the core is well known and it is generally executed by injection molding.

EXAMPLES

The present invention is described in further detail according to Examples. However, the present invention is not limited to these Examples.

Examples 1–3 and Comparative Examples 1–4

A rubber composition was obtained by kneading the rubber composition for the core shown in Table 1. Thus obtained rubber composition was cured and molded under the conditions given in Table 1. Hardness distribution and compression strength of thus obtained core are shown in Table 1.

The cover obtained by the ordinary method with the composition shown in Table 2 was covered with the aforesaid core. Stiffness and thickness of the cover used are shown in Table 2.

Table 3 shows the hardness (indicated by PAG) durability index, rebound coefficient, flight characteristics, such as launch angle, spin, carry etc. and results of hit feeling evaluation.

TABLE 1

| | | Core | | | | | | |
|---|---|---|---|---|---|---|---|---|
| | | Ex. 1 | Ex. 2 | Ex. 3 | Comp. Ex. 1 | Comp. Ex. 2 | Comp. Ex. 3 | Comp. Ex. 4 |
| Formulation | BR-01*[1] | 100 | 100 | 100 | 100 | 100 | 100 | 100 |
| | Zinc diacrylate | 31 | 29 | 27 | 31 | 25 | 31 | 31 |
| | Zinc oxide | 17.5 | 18.2 | 19.0 | 20.0 | 20.0 | 20.4 | 16.6 |
| | Antioxidant | 0.5 | 0.5 | 0.5 | 0.5 | 0.5 | 0.5 | 0.5 |
| | Dicumyl peroxide | 2.2 | 2.2 | 2.2 | 2.2 | 2.0 | 1.8 | 2.3 |
| Condition of curing | Temperature | 155° C. | 155° C. | 155° C. | 145° C. | 160° C. | 160° C. | 152° C. |
| | Period of time | 25 min. | 25 min. | 25 min. | 40 min. | 25 min. | 25 min. | 25 min. |
| Hardness distribution | Center | 71 | 65 | 60 | 70 | 56 | 62 | 65 |
| | 5 mm from center | 76 | 73 | 70 | 76 | 67 | 75 | 76 |
| | 10 mm from center | 76 | 73 | 70 | 81 | 67 | 75 | 76 |
| | 15 mm from cener | 86 | 84 | 79 | 83 | 75 | 79 | 86 |
| | Surface | 87 | 85 | 80 | 78 | 77 | 85 | 86 |
| Compression | (mm) | 2.9 | 3.1 | 3.4 | 2.6 | 3.7 | 3.2 | 2.7 |

*[1]Butadiene rubber available from Japan Synthetic Rubber Co., Ltd.

TABLE 2

| | | Cover | | | | | | |
|---|---|---|---|---|---|---|---|---|
| Formulation*[2] | HIMILAN 1076 | 50 | 50 | 50 | 50 | 50 | 50 | 50 |
| | HIMILAN 1605 | 50 | 50 | 50 | 50 | 50 | 50 | 50 |
| Stiffness*[3] | 23° C. × 2 weeks | 3300 | 3300 | 3300 | 3300 | 3300 | 3300 | 3300 |
| Thickness | (mm) | 1.9 | 1.9 | 1.9 | 1.9 | 1.9 | 2.3 | 1.4 |

*[2]2 Wt parts of titanium oxide ($TiO_2$) was added to 100 wt parts of ionomer resin and coloring was conducted by an extruder to prepare a resin composition used for the cover.
*[3]Stiffness was measured by a Stiffness Tester manufactured by Toyo Seiki Co., Ltd. A specimen was a flat plate made by press-molding and measurement was made after leaving the specimen for 2 weeks at 23° C. and 50% humidity.

TABLE 3

| | Ball evaluation | | | | | | |
|---|---|---|---|---|---|---|---|
| | Ex. 1 | Ex. 2 | Ex. 3 | Comp. Ex. 1 | Comp. Ex. 2 | Comp. Ex. 3 | Comp. Ex. 4 |
| Hardness (PGA) | 105 | 100 | 95 | 110 | 88 | 100 | 92 |
| Durability index*4 | 100 | 99 | 97 | 115 | 75 | 105 | 80 |
| Rebound coefficient (45 m/s) | 0.7820 | 0.7810 | 0.7800 | 0.7830 | 0.7720 | 0.7790 | 0.7735 |
| Flying characteristics*5 | | | | | | | |
| Launch angle (°) | 12 | 12.2 | 12.5 | 11.4 | 12.8 | 12 | 10 |
| Spin (rpm) | 2600 | 2580 | 2550 | 2800 | 2500 | 2600 | 3200 |
| Carry (yard) | 230 | 230 | 230 | 230.5 | 227 | 228 | 220 |
| Feeling evaluation | Light, soft and good | Light, soft and good | Light, soft and good | Hard | Too soft and heavy | Slightly hard and feel hardness of cover | Soft, heavy and dull |

*4 Durability index: Withstand frequency of impact given to the specimen in Example 1 is deemed 100. Frequency of impact is the frequency of impact given until breaking of ball occurs, by shooting out the ball at the speed of 45 m/sec. by a swing robot manufactured by True Temper Co.

*5 45 m/sec. W1 flight (flight charactetristics): The value obtained in the test to shoot out a ball by W1 (No. 1 Wood) at 45 m/sec. using the swing robot.

As it is evident from the results of Tables 1, 2 and 3, the balls of Examples 1–3 are light, soft, gives good hit feeling and their characteristics are closer to those of thread-wound golf balls. Durability and flight performance are also good.

The golf ball of Comparative Example 1 has the core with small compression strength (2.6 m/m), hardness of the ball is high, and the hit feeling is hard and inferior.

The ball of Comparative Example 2 has a large core compression strength (3.7 mm) and low hardness, and it is too soft and heavy and its hit feeling is insecure and inferior. Durability is low.

The ball of Comparative Example 3 has thick cover and its hit feeling was hard and inferior.

The ball of Comparative Example 4 has thin cover, its hit feeling is closer to that of one piece golf ball and its hit feeling is soft and heavy. The ball spins easily and has poor flight performance and durability.

The two-piece golf ball of the present invention has hit feeling close to that of thread-wound golf ball and its flight performance is the one specific to the two-piece golf ball and it has preferred characteristics as a golf ball in regard to both flight performance and hit feeling.

What is claimed is:

1. A two-piece golf ball comprising a core formed from a rubber composition Comprising a base rubber, a co-crosslinking agent and an organic peroxide, and a cover covering the core, wherein said core has the following hardness distribution when measured by a JIS-C hardness meter;

(1) hardness at a center: 58–73

(2) hardness at 5–10 mm from the center: 68–78

(3) hardness at 15 mm from the center: 76–88

(4) surface hardness: 78–88 wherein in the hardness distribution, hardness (2) is substantially constant being within the above range, of which tolerance is within ±3 and the other values satisfy the relation of (1)<(2)<(3)≦(4), a compression deformation of the core is 2.8–3.5 mm when pressurized by an initial load of 10 kg up to a final load of 130 kg and said cover has a thickness of 1.5–1.9 mm.

2. The golf ball according to claim 1 wherein said core is made from a rubber composition which comprises cis-1,4-butadiene rubber, zinc diacrylate and dicumyl peroxide.

3. The golf ball according to claim 2 wherein said rubber composition further comprises filler and antioxidant.

4. The golf ball according to claim 1 wherein said cover is formed from an ionomer resin and filler.

5. The golf ball according to claim 1 wherein said cover has a stiffness of 3,000 to 4,500 Kg/cm$^2$.

* * * * *